United States Patent [19]

Burke

[11] Patent Number: 4,699,267

[45] Date of Patent: Oct. 13, 1987

[54] PORTABLE SHOE RACK FOR TRAVELERS

[76] Inventor: James A. Burke, 5796 Pepperwood Ct., Galloway, Ohio 43119

[21] Appl. No.: 935,761

[22] Filed: Nov. 28, 1986

[51] Int. Cl.[4] ..... B65D 85/18

[52] U.S. Cl. ..... 206/278; 190/16; 190/13 F; 206/292; 211/34

[58] Field of Search ..... 211/34–38; 190/16, 13 F; 206/278, 292, 296, 298

[56] References Cited

U.S. PATENT DOCUMENTS

| | | | |
|---|---|---|---|
| D. 165,942 | 2/1952 | Stein | 211/34 X |
| 940,812 | 11/1909 | Hermann | 211/34 |
| 1,968,580 | 7/1934 | Wheary | 206/292 |
| 2,928,549 | 3/1960 | Neuwirth | 211/34 |
| 2,943,899 | 7/1960 | Beller | 211/34 |
| 3,563,390 | 2/1971 | Kim | 211/35 |
| 3,858,693 | 1/1975 | Dubenko | 211/34 X |
| 4,460,094 | 7/1984 | Schoen | 211/35 |

FOREIGN PATENT DOCUMENTS

| | | | |
|---|---|---|---|
| 131 | of 1885 | United Kingdom | 211/34 |
| 628690 | 9/1949 | United Kingdom | 211/37 |

*Primary Examiner*—William Price

*Attorney, Agent, or Firm*—Robert B. Watkins

[57] ABSTRACT

A luggage case provided with a removably mounted shoe rack for storing and transporting a plurality of pairs of shoes. The generally conventional luggage case includes a rectangular compartment and a hinged cover detachably connected thereto to open and close the compartment. The shoe rack includes rectangular, open rigid frame which is conformed to closely fit within the confines of the luggage compartment and a pair of horizontally extending rows of shoe-receiving members supported on said frame. The shoe receiving members are in the form of inwardly and upwardly directed prongs adapted to receive a shoe, toe first, with the general boundaries of said frame. Also included is a flexible pocket formed in the top of the frame having a closure flap to permit storage of other personal items therein.

5 Claims, 5 Drawing Figures

PORTABLE SHOE RACK FOR TRAVELERS

BACKGROUND OF THE INVENTION

The present invention relates generally to hand luggage and specifically to a combined luggage and portable shoe rack. Prior to the present invention, portable racks or shoe carrying cases have been devised for travelers to transport a plurality of pairs of shoes. These devices were designed specifically to carry nothing but shoes and representative examples include U.S. Pat. Nos. 1,705,150; 2,916,150 and 2,943,899. Another example of prior art devices is represented by U.S. Pat. No. 1,968,580. This device accomodates the traveler by providing a piece of hand luggage which includes foldable inner walls or compartments which could be used to store shoes in addition to carrying other personal luggage items. It also provides a means to fold away these compartments to permit the whole luggage compartment to be used for general purposes.

None of the prior luggage cases or shoe racks satisfactorily address the problem of the inconvenience for travelers carrying a plurality of shoes after one arrives at a given destination where the various pairs of shoes will be used. Utilizing the prior devices requires one to "live out" of the luggage case or to remove the shoes stored on the rack and place them loose at random in the closet or elsewhere in the room.

Prior to the present invention there was no device provided which functions as a combined luggage case and portable shoe rack having provision to store personal items and wherein the shoe rack was removable as a whole from the general carrier for conveniently serving as independent shoe rack during the travelers stay at his destination thereby providing a facile and organized manner of storing shoes for use as well as transport.

SUMMARY OF THE INVENTION

The present invention relates generally to portable shoe racks and particularly to a novel and improved combination of a luggage case and removably mounted shoe rack. This combination provides not only a combined shoe and general personal item luggage case, but further provides a shoe rack which is easily removed from the carrying case for independent organized storage and use of the shoes after the traveler reaches his destination. The shoe rack of the present invention is adapted to fit snuggly within the luggage case yet may be removed as a whole unit and placed in the motel or hotel closet or other location for continued use during the travelers stay.

The luggage case may comprise a generally conventional piece of hand luggage of the type having a generally rectangular luggage compartment and a hinged cover for closure of the compartment. The portable shoe rack includes a generally rectangular box-like open frame which includes a forward and rearward horizontally extending row of vertically directed shoe-receiving members.

The box-like frame is conformed to fit within the luggage compartment to provide convenient storage of shoes and, in addition, provide storage space between the shoe-receiving members for general personal items.

Preferably, the shoe-receiving means comprise prongs or hanger means which are bent inwardly and upwardly to receive a shoe within the confines of the open box frame.

OBJECTS

It is therefore an object of the present invention to provide a combination hand luggage case and shoe rack wherein the shoe rack is removably mounted with the case to both transport shoes and other general personal items and yet may be removed as a whole to function as an independent shoe rack.

It is another object of the present invention to provide a combination luggage case and portable shoe rack which may be conveniently used to store shoes in an organized manner in the home and also readily be removably mounted in a luggage case for transportation and use away from the home.

It is yet another object of the present invention to provide the novel apparatus of the type described which includes a pair of rows of shoe-receiving means aligned in a front to rear relationship in an open box-like frame which economizes the spacial arrangement of a plurality of pairs of shoes and yet provides a general interior space for the storage of personal items of general use.

IN THE DRAWINGS

DETAILED DESCRIPTION

Figure 1:
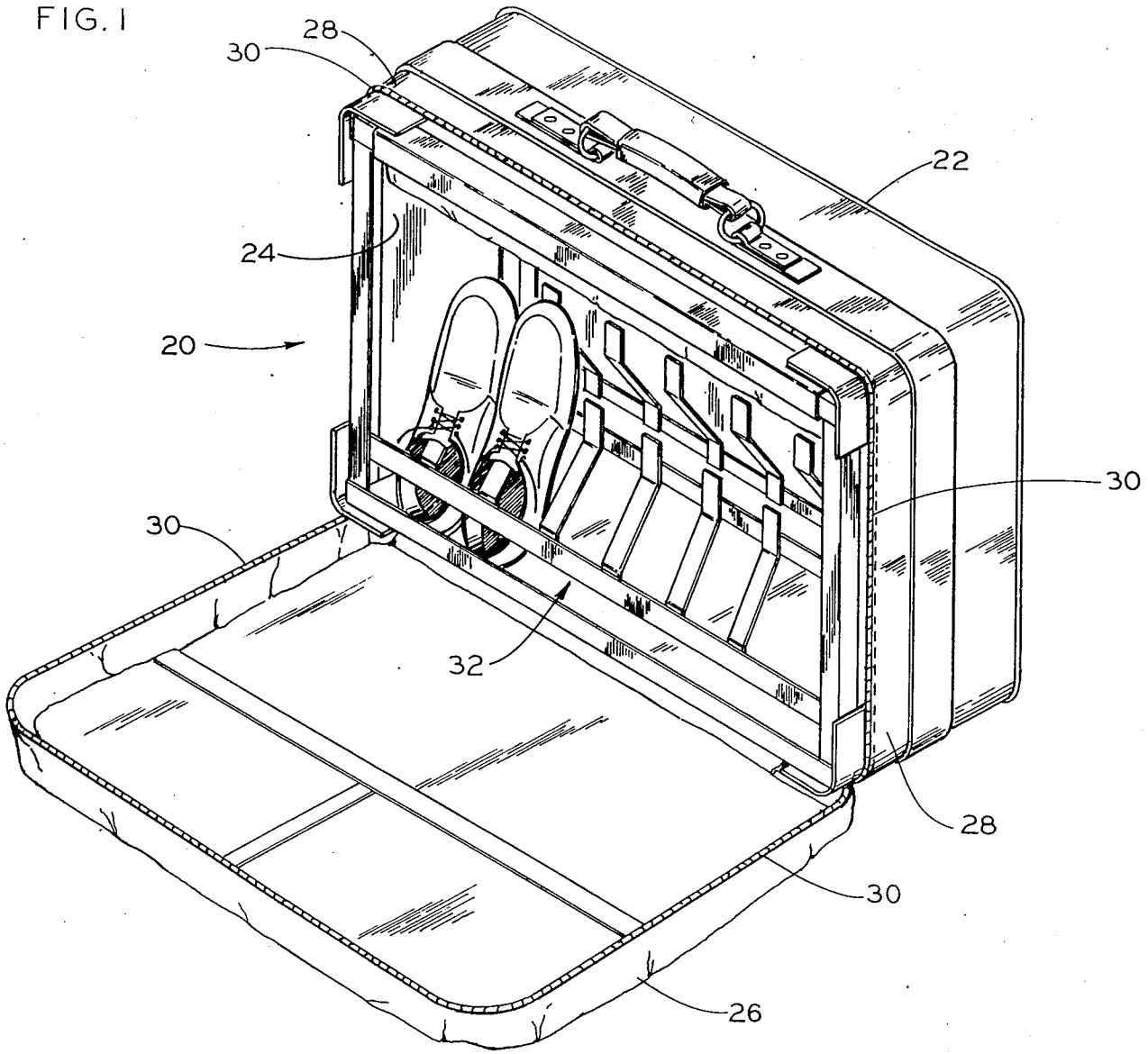
FIG. 1 is a perspective view of a combination luggage case and portable shoe rack constructed in accordance with the present invention.
Figure 2:
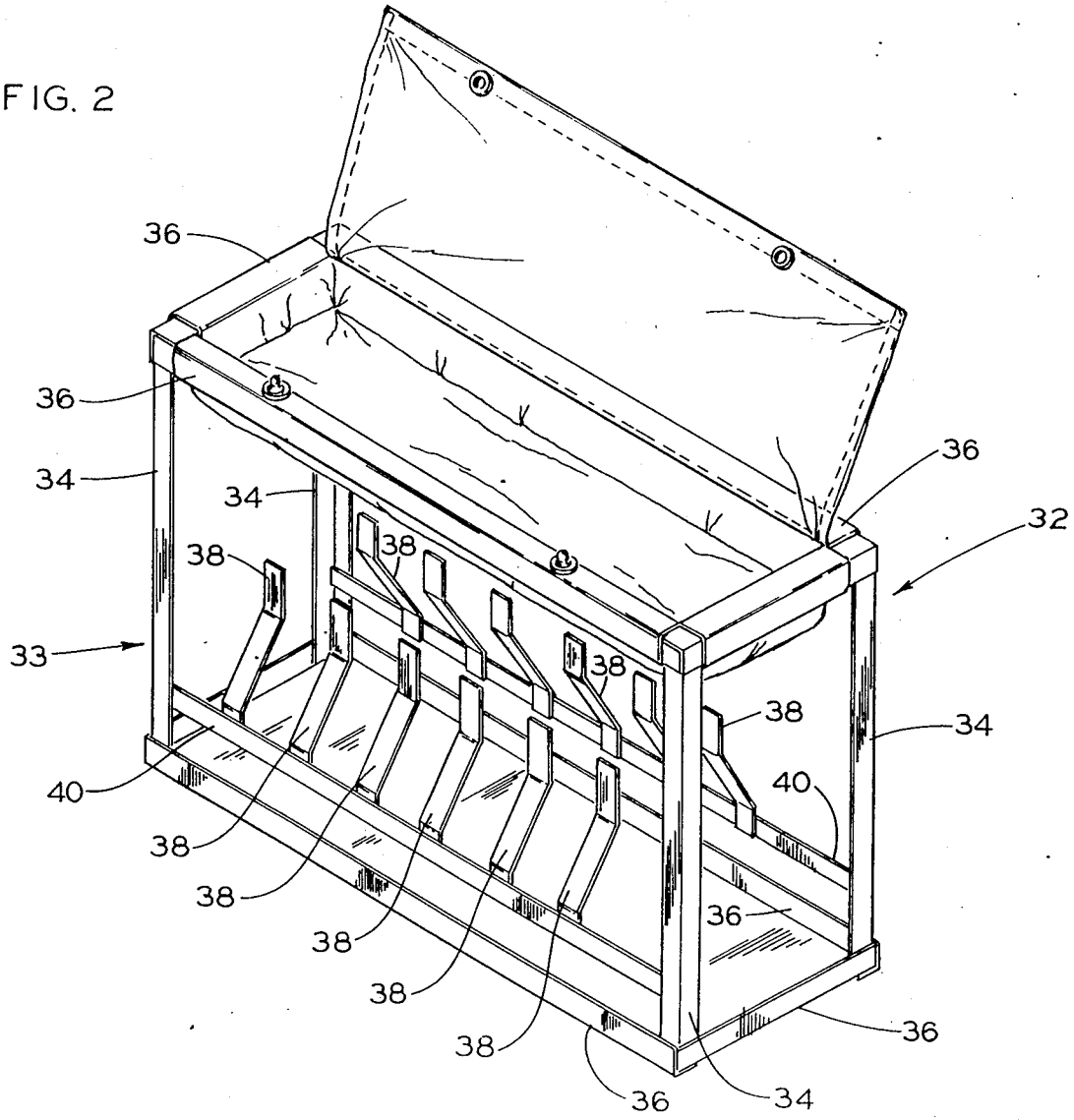
FIG. 2 is a perspective view of the portable shoe rack portion of the present invention shown in FIG. 1, illustrating the shoe rack removed from the luggage case.

A luggage case and removably mounted portable shoe rack constructed in accordance with the present invention is shown in FIG. 1 and is indicated generally at 20. The luggage case 22 is of conventional construction and includes a generally rectangular space forming a luggage compartment 24 and a cover portion 26 hinged along the bottom to open and close the compartment 24 in a conventional manner. In the embodiment shown, the cover portion 26 is detachably connected around the side and top walls 28 by a conventional zipper closure means operable on a track 30. However, the luggage csae portion 22 may be of other conventional construction which provides the generally rectangular luggage compartment and a hinged cover detachably connected thereto in any suitable manner without departing from the spirit of the present invention.

A portable shoe rack, indicated generally at 32, is removably mounted within and conforms to the spacial confines of compartment 24. As best seen in FIGS. 2–5, shoe rack 32 includes a generally rectangular box-like, open frame portion 33 comprising vertical support members 34 and a plurality of horizontal support members 36 interconnected to the vertical members 34 at the eight corners of the frame. The members 34 and 36 may be connected to one another in any suitable conventional manner, such as by rivots, welding or the like. The frame 33 is relatively rigid and forms a sturdy support capable of standing alone. When it is disposed within compartment 24, it is sufficiently rigid to generally reinforce the luggage case 22 against deformation or the like encountered during normal use and handling to provide added protection of the contents thereof.

Front to rear spaced rows of shoe-receiving means are provided in the form of vertically extending prongs or hangers, such as 38, horizontally spaced from one another in a fixed position along the length of a respective horizontal support bar 40. Each support bar 40 is rigidly fixed at its respective ends to a pair of vertical supports 34 defining the width of the frame 33 across the front and rear faces thereof. The bars 40 are preferably disposed above the horizontal support members 36 defining the bottom of rack 32 and below the midpoint of vertical members 34, a distance sufficient to permit a shoe to be disposed over the free upper end of a hanger 38, toe first, with the heel end of the shoe resting near or in contact with the bottom wall of compartment 24, such as seen in FIG. 1. Or in the alternative, when the rack 32 is removed from the luggage carrier 22, the heel of the shoe would rest near or upon the floor upon which rack 32 is placed.

Figure 5:
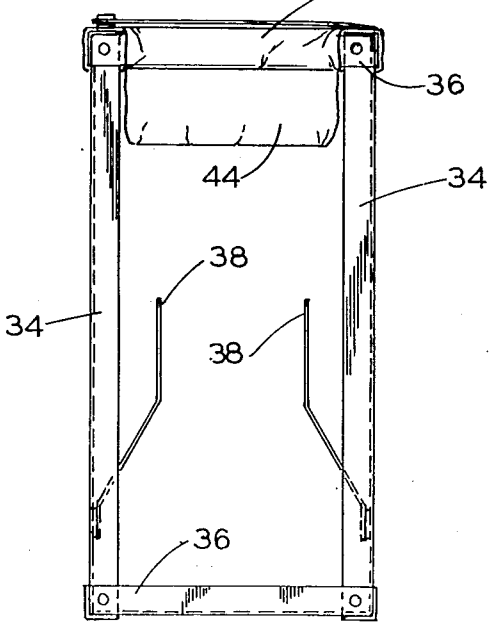
FIG. 5 is an end elevational view of the shoe rack portion shown in FIG. 3.
Figure 3:
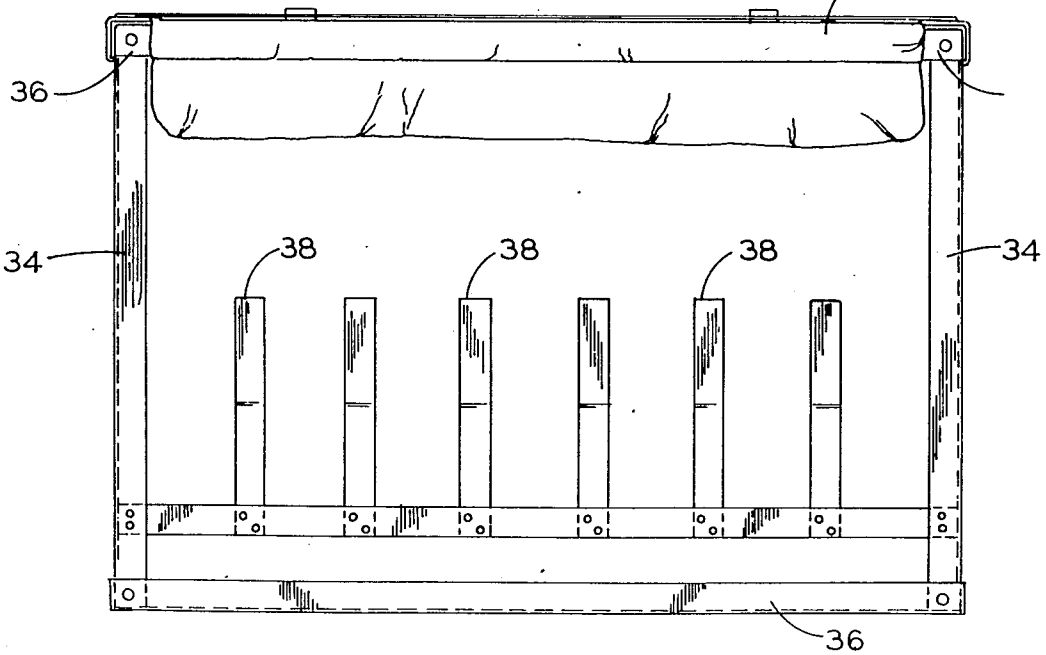
FIG. 3 is a front elevational view of the shoe rack portion shown in FIG. 2.

As best seen in FIG. 5, the prongs 38 forming the rows of shoe-receiving means are angled inwardly toward the center area of the frame 33 and define a generally central area within the confines of frame 33 forming a storage area above and below any shoes disposed upon prongs 38 for other personal items of general use. Further, the inwardly directed angled portion of prong 38 aid in fixing a shoe upon a prong 38 in a more stable storage position and position the shoe within the general confines defined by the frame. This construction tends to offer a greater degree of protection to the shoes stored on the prongs 38 within the case 22 due to the reinforcement effect of the frame 33 which resists deformation of the luggage case due to the weight of other pieces of luggage or the like which often may be stakced upon the luggage case 22 during transit.

As an added convenience, in the preferred form of the present invention, a pocket portion may be included to store additional items such as slippers or smaller personal items for example.

Such a pocket may be formed of a flexible material 42 such as plastic sheet material for example. The sheet 42 includes sufficient excess length to hang below the upper portion of the frame to form a pouch-like pocket 44 which is attached via overlapping the edges of the sheets 42 upon itself around the horizontal support members 36 and stitching the overlapped sheet portions together as indicated at 46.

Figure 4:
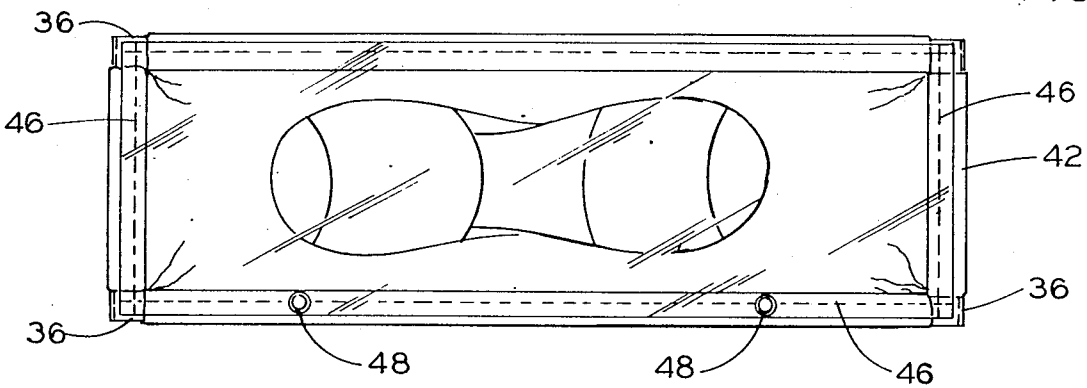
FIG. 4 is a top plan view of the shoe rack portion shown in FIG. 3.

If desired, a closure flap, not shown, can be easily provided by sewing an additional sheet along one edge of the sheet 42. Detachable closure means in the form of female snap portions disposed in the opposing edge which detachably receive a mated male portion extending upwardly through support member 34 and sheet 42 as seen in FIG. 4, may be conventionally provided to permit the pocket to be opened and closed.

The frame 33 is dimensioned to removably fit relatively snuggly within the inner boundary of the generally rectangular compartment 24 such that it assumes a stable portion therein during transport.

In view of the foregoing description, it should be readily understood that the shoe rack 32 may be conveniently used in the home, independent from the luggage case 22, for the organized storing of the user's shoes. When the user wishes to travel for a time period wherein it is desirable to take several pairs of shoes, the rack 32 may be readily mounted within the luggage carrier 32 as described. Those shoes already in the rack 32 or those substituted in their place are mounted on prongs 38. Additional personal items may also be placed within compartment 24 as space permits. When the user arrives at the intended designation, shoe rack 32 may be conveniently removed as a whole and placed in a closet or other convenient location without removing the shoes mounted on prongs 38 to provide a convenient and organized manner to store and use the shoes as desired.

Therefore, whether at home or during travel away from home, a user is provided the same convenient shoe storage means which eliminates aggravating misplacement of shoes and provides a better mode of proper care for the shoes when not in use. When the one is ready to leave, one merely mounts the shoe rack 32 and shoes mounted thereon into the luggage case 22 in the same manner as previously described for conveniently transporting them to the next location. Upon arrival at home, the user merely removes the shoe rack 32 and the shoes as a whole and replaces the rack 32 in the closet or other desired location from which it was originally stored.

What is claimed is:

1. A portable shoe rack comprising, in combination, a generally rectangular frame including four vertically disposed corner support members and a plurality of horizontal support members interconnected to said vertical supports to define a rigid box-like open frame; a plurality of shoe-receiving prongs fixed to said frame and extending upwardly and inwardly from a lower one of said horizontal supports, said prongs being arranged in a first horizontally disposed row and a second horizontally disposed row rearwardly spaced from said first row for accepting a shoe on each prong, toe first, with the shoe generally positioned within the boundary defined by said frame.

2. The shoe rack defined in claim 1 wherein said box-like frame has a width greater than its height or depth and including horizontally extending support bars fixed to a pair of forwardly and rearwardly disposed vertical support members at a position below the midline of said vertical support members; and said prongs being fixed to a respective one of said support bars to define said horizontally extending rows.

3. A combined hand luggage case and portable shoe rack, comprising in combination, (1) a hand luggage case having a generally rectangular luggage compartment and a hinged cover for opening and closing said compartment; (2) a shoe rack having a generally rectangular configuration comprising four vertical extending supports interconnected wtih top and bottom horizontally disposed supports defining an open box-like frame removably mounted within said luggage compartment in closely fit relationship thereto; said rack including a pair of horizontally extending cross bars, a respective one fixed to the front and rear of said frame and disposed below the centerline of said vertical supports and a plurality of horizontally spaced, vertically extending shoe-receiving members fixed to each of said cross bars; and an open space defined between said shoe-receiving means for storage of other personal luggage items between the confines of said box-like frame.

4. The combination defined in claim 3 wherein each of said shoe-receiving members comprise an upwardly and inwardly directed prong conformed to receive a shoe, toe first, in a stable position within the general confines defined by said box-like frame.

5. The combination defined in claim 3 wherein said shoe rack includes a pocket means formed by a flexible sheet of material having its outer edges fixed to the horizontal support members defining the top of said box-like frame and an inner portion extending downwardly into the confines of said frame; and a closure flap fixedly hinged at one end to an edge portion of said flexible sheet and having an opposing free end detachably connected to said frane to cover said pocket means.

* * * * *